United States Patent [19]

Itoh et al.

[11] Patent Number: 4,532,685

[45] Date of Patent: Aug. 6, 1985

[54] METHOD OF ASSEMBLING A RECIPROCATING COMPRESSOR

[75] Inventors: Kazuhiro Itoh, Wako; Mutsuo Sugisaki, Kamifukuoka; Hiroshi Tanaka, Niiza, all of Japan

[73] Assignee: Honda Giken Kogyo Kabushiki Kaisha, Tokyo, Japan

[21] Appl. No.: 468,660

[22] Filed: Feb. 22, 1983

[30] Foreign Application Priority Data

Feb. 23, 1982 [JP] Japan ..... 57-27668

[51] Int. Cl.[3] ..... B23P 15/00

[52] U.S. Cl. ..... 29/156.4 R; 29/407; 29/434; 92/60.5; 417/550; 417/562; 417/564

[58] Field of Search ..... 29/156.4 R, 407, 434; 92/60.5; 417/562, 564, 550

[56] References Cited

U.S. PATENT DOCUMENTS

| | | | |
|---|---|---|---|
| 1,470,548 | 10/1923 | Spohrer | 417/550 X |
| 1,996,346 | 4/1935 | Mueller | 29/407 |
| 2,000,883 | 5/1935 | Cullen et al. | 417/550 X |
| 2,296,883 | 8/1942 | Trask | 417/550 X |
| 2,833,462 | 5/1958 | Scheerer | 92/60.5 |
| 3,961,868 | 6/1976 | Droege, Jr. et al. | 417/550 |
| 4,250,844 | 2/1981 | Tews | 417/550 X |
| 4,408,389 | 10/1983 | Henein | 29/407 X |

FOREIGN PATENT DOCUMENTS

| | | | |
|---|---|---|---|
| 5353 | 1/1978 | Japan | 92/60.5 |

*Primary Examiner*—Howard N. Goldberg
*Assistant Examiner*—Ronald S. Wallace
*Attorney, Agent, or Firm*—Handal & Morofsky

[57] ABSTRACT

A method of assembling a reciprocating compressor, in which a piston for partitioning a cylinder into a compression chamber and a suction chamber is telescoped in the cylinder, a closure end plate is secured at an open end of the cylinder, the end surface of the piston and the bottom surface of the end plate define opposing sides of the compression chamber, the piston is perforated by a suction port for communicating between the compression chamber and the suction chamber, and a suction valve sits on the piston for opening and closing the suction port, comprising the following steps; (1) manufacturing in advance a plurality of closure end plate, the i-th end plate having a bottom surface formed by a projection of different height $h_i$; (2) defining two reference positions of the piston and cylinder, respectively, for the i-th compressor and measuring the interval $D_i$ between the reference positions; (3) selecting an end plate which has a projection of such a height that $D_i - h_i$ equals a predetermined constant; and (4) securing the selected end plate to the cylinder of the measured compressor. The suction valve is seated on the recessed valve seat surface formed on the end surface of the piston. The outer surface of the suction valve (i.e., the surface confronting the compression chamber) is disposed in the same plane as or slightly below the top surface of the piston (i.e., non-recessed part of the piston's end surface).

1 Claim, 6 Drawing Figures

METHOD OF ASSEMBLING A RECIPROCATING COMPRESSOR

BACKGROUND OF THE INVENTION

1. Technical Field of the Invention

The present invention comprises a method for assembling a reciprocating compressor for use in an air conditioning unit and a reciprocating compressor obtained by the method.

2. Description of the Prior Art

Reciprocating compressors are well known in the prior art. A conventional compressor comprises a piston slidably telescoped into a cylinder. The internal volume of the cylinder is divided into two chambers by the piston: a suction chamber and a compression chamber. The suction and compression chambers are connected by suction ports that perforate the piston. The suction ports are opened and closed by a plate-shaped suction valve mounted on the piston. The suction valve is opened at the suction stroke of the piston, during which gas or fluid is sucked from the suction chamber into the compression chamber. The suction valve is closed at the compression stroke of the piston, during which gas or fluid in the compression chamber is compressed.

In such a reciprocating compressor it is desirable to improve the volumetric efficiency of the cylinder and to eliminate any irregular performance of the compressor. The volumetric efficiency of the cylinder can be improved by minimizing the volume of the compression chamber when the piston is disposed at the top of its stroke. Irregular performance of the compressor can be eliminated by ensuring that the minimum volume of the compression chamber of each compressor is constant.

A drawback of conventional compressors is that the minimum volume of the compression chamber is not constant from one compressor to the next. The cylinder, piston and other components are generally machined to within a specified tolerance. When the effect of the tolerances of all of the components are added together, the differences in chamber volume can be significant. Even slight differences in chamber volume could result in irregular performances by the respective compressors.

Of course, consistent performance is preferred because the rest of the air conditioning unit is designed to cooperate with a compressor having a specified performance. Any variation from this specified performance will adversely affect the unit as a whole. Thus, to prevent such variation in the chamber volume, the solution commonly employed is to machine the respective components to extremely high accuracy (i.e., low tolerance). Such precise machining increases the cost of manufacturing the compressor.

Another disadvantage of conventional compressors is that, although the seat surface of a suction valve can be accurately machined, the seat surface is frequently damaged during handling of the piston. For example, during assembly of the compressor, the seat surface might collide with another component, thereby causing the seat surface to be scratched. The result of having a seat surface with an imperfection is that the performance of the suction valve is adversely affected so as to lower the compression ratio.

SUMMARY OF THE INVENTION

The present invention is intended to eliminate the foregoing disadvantages. The invention comprises a method for assembling a reciprocating compressor which eliminates the irregularity in minimum volumes of compression chambers for compressors which are determined when pistons within the compression chambers are positioned at the top of their strokes, provides high volumetric efficiency, and significantly improves compressor performance. This method for assembling a reciprocating compressor also eliminates the possibility that the seat surface of the suction valve will be scratched by other components during assembly. The compressor is assembled simply and effectively.

The method of assembling the reciprocating compressor comprises the following steps. A plurality of closure end plates are manufactured in advance, each closure end plate having a disk like projection of unique height. When each closure end plate is set in position, its projection extends into the compression chamber. The compression chamber is defined by the top surface of the piston, the cylinder walls, and the closure end plate projection. After the appropriate measurement has been made, a particular closure end plate is selected according to the height of its projection. The closure end plate is inserted during assembly if the height of its projection is such that the minimum volume of the compression chamber thereby defined is equal to the desired value. Thus, by selecting a closure end plate having a projection of predetermined height for each compressor, the minimum volume of the compression chamber can be kept constant for all compressors.

The present invention also comprises the reciprocating compressor which results from the above-summarized method of assembly.

BRIEF DESCRIPTION OF THE DRAWINGS

The present invention will be described in greater detail in conjunction with the following drawings.

DESCRIPTION OF THE PREFERRED EMBODIMENT

Figure 1:
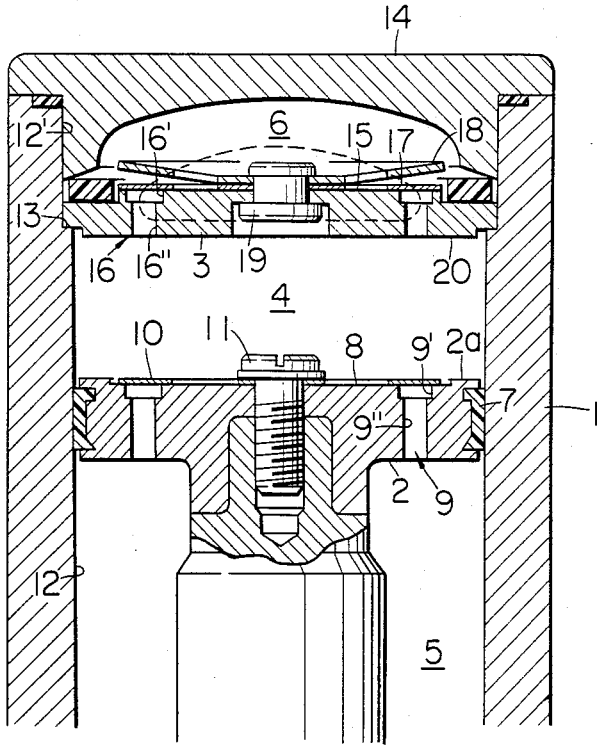
FIG. 1 is a sectional side view of the preferred embodiment of the reciprocating compressor according to the present invention.

FIG. 1 shows an assembled reciprocating compressor according to the present invention. Cylinder 1 has two sections 12 and 12' bore of different diameters, in the smaller of which (12) piston 2 is telescoped. A closure end plate 3 is fixedly secured to the open end of cylinder 1 such that it confronts the end surface of piston 2. The end surface of piston 2 comprises top surface 2*a* and recessed valve seat surface 8. A compression chamber 4 is defined by the end surface of piston 2, the inner wall of cylinder 1, and the bottom surface of end plate 3. A suction chamber 5 is defined by the back surface of piston 2 and the inner wall of cylinder 1.

A piston ring 7, which is in intimate contact with the inner wall of cylinder 1, is snugly engaged around the piston. Piston ring 7 acts as a hermetic seal between compression chamber 4 and suction chamber 5. The piston surface facing compression chamber 4 comprises top surface 2*a* and recessed valve seat surface 8. Piston 2 is perforated by suction port 9, which communicates between compression chamber 4 and suction chamber 5. Suction port 9 comprises an annular groove 9′ lying directly below valve seat surface 8 and a plurality of vent holes 9″ arrayed along annular groove 9′. Valve seat surface 8 is a circular recess, the outer radius of which is greater than the outer radius of annular groove 9′, measured from the axis of symmetry of piston 2. Vent holes 9″ communicate between annular groove 9′ and suction chamber 5. A suction valve 10 formed of a thin flexible metal disk is fixed to valve seat surface 8 by fixture 11, (e.g., a screw). Suction port 9 is opened and closed by the flexing of suction valve 10. As piston 2 moves downward, suction valve 10 bends, thereby opening suction port 9. When piston 2 moves upward, suction valve 10 is not bent and suction port 9 is closed. Suction valve 10 is formed such that its top surface lies in the same plane as or slightly below top surface 2*a* of piston 2 when the suction valve is in the closed position.

The bore of cylinder 1 comprises two sections of different diameters: a small-diameter section 12 and a large-diameter section 12′ (with the terms small and large used in the relative, not absolute sense). Stopper step 13 is formed by the juncture of bore sections 12 and 12′. As noted earlier, piston 2 is telescoped in bore section 12. End plate 3 lies along a plane transverse to the axis of bore section 12′ and abuts stopper step 13. Head member 14 is fixed to the end of cylinder 1. The dimensions and configuration of head member 14 are such that end plate 3 is rigidly interposed between stopper step 13 and head member 14. The bottom surface of head member 14 and the top surface of end plate 3 define an exhaust chamber 6.

A valve seat surface 15 is formed on the upper surface of end plate 3, i.e., on the end surface which is not facing compression chamber 4. An exhaust port 16, which communicates between compression chamber 4 and exhaust chamber 6 communicating with a suitable fluid supply unit, perforates end plate 3. Exhaust port 16 comprises an annular groove 16′ lying directly below valve seat surface 15 and a plurality of vent holes 16″ arrayed along annular groove 16′. Vent holes 16″ communicate between annular groove 16′ and compression chamber 4. An exhaust valve 17 formed of a thin flexible metal disk is fixed to valve seat surface 15 by fixture 19 (e.g., a rivet). Exhaust port 16 is opened and closed by the flexing of exhaust valve 17. As piston 2 moves upward, exhaust valve 17 bends, thereby opening exhaust port 16. When piston 2 moves downward, exhaust valve 17 is not bent and exhaust port 16 is closed. A stopper plate 18 is superposed on exhaust valve 17.

A disk-shaped projection 20 is integrally formed with the lower surface of end plate 3, with the end surface of projection 20 facing compression chamber 4. Projection 20 is crucial to the concept of the present invention in that it serves to eliminate any irregularity in the minimum volume of the compression chamber in compressors which is determined when the piston is disposed at the top of its stroke, the compressors having been machined to within a predetermined tolerance. Projection 20 also enhances the volumetric efficiency of the compressor by reducing the minimum volume of the compression chamber. These functions of the end plate projection will be discussed in greater detail later.

As piston 2 moves downward during operation of the compressor, compression chamber 4 is expanded, suction valve 10 is deflected upward, and suction port 9 is opened. At the same time, exhaust valve 17 is not deflected and exhaust port 16 is closed. Accordingly, a fluid in suction chamber 5 is sucked into the compression chamber 4 as a result of the pressure differential between the chambers. When piston 2 subsequently moves upward, the volume of compression chamber 4 is reduced, suction valve 10 is not deflected, and suction port 9 is closed. At the same time, exhaust valve 17 is deflected upward and exhaust port 16 is opened. Due to the increased pressure in compression chamber 4, fluid is forced into exhaust chamber 6 and is fed to the appropriate equipment of the air conditioning unit.

Figure 3A:
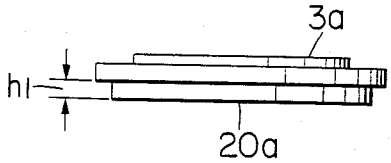
FIG. 3 is a side view of three closure end plates according to the present invention, each closure end plate having a projection of different height.
Figure 3B:
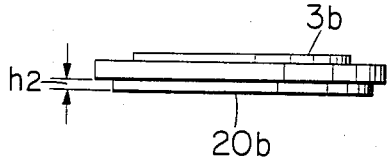
Figure 3C:
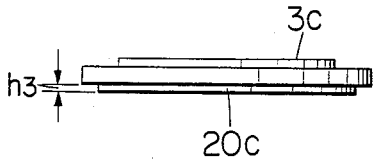

In the present invention, the volume of compression chamber 4 at the peak amplitude of piston 2 is adapted to be a minimum so as to enhance the volumetric efficiency and eliminate the irregularity in the minimum volume of the compression chambers of respective compressors. This is achieved by manufacturing a plurality of end plates 3, each end plate being distinguished by a unique height of its projection 20. The plurality of heights vary by a small interval over a predetermined range. The projection 20 of end plate 3 intrudes into compression chamber 4, thereby reducing the minimum volume of compression chamber 4 accordingly. FIG. 3A, B, and C shows end plates 3*a*, 3*b*, and 3*c*, respectively, comprising projections 20*a*, 20*b*, and 20*c*, respectively. Projections 20*a*, 20*b*, and 20*c* have heights $h_1=15/100$ mm, $h_2=10/100$ mm, and $h_3=5/100$ mm, respectively (the heights $h_1$, $h_2$, and $h_3$ shown in FIG. 3A, B, and C, respectively, are exaggerated for the purpose of illustration).

Figure 2:
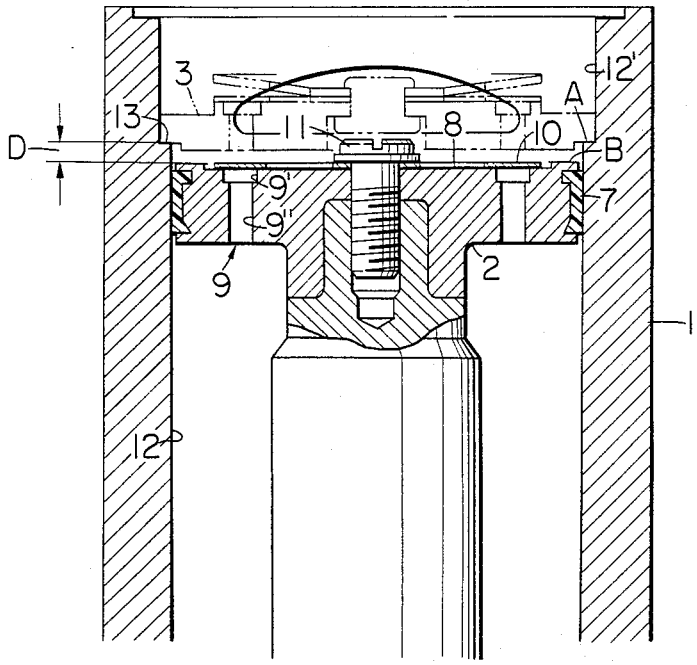
FIG. 2 is a sectional side view of the preferred embodiment of FIG. 1 at the moment of measurement and prior to insertion of the closure end plate.

FIG. 2 shows the compressor at the assembly stage preceding insertion of end plate 3. The reference positions of cylinder 1 and piston 2 for purposes of adjusting the minimum volume of compression chamber 4 are defined. The estimated minimum volume of compression chamber 4 is taken to be equal to the volume defined by the plane in which stopper step 13 lies, the top surface of piston 2 at peak amplitude of the piston stroke, and the bore 12 of cylinder 1. Since the volume of a cylinder is linearly proportional to the length of the cylinder, the estimated minimum volume of compression chamber 4 will be linearly proportional to the distance between the plane in which stopper step 13 lies (i.e., position A) and the top surface of piston 2 at peak amplitude of the piston stroke (i.e., position B). (It will be noted that other reference positions would be equally suitable for the purposes of measurement.) The interval D between postions A and B can be accurately measured by an optical technique.

The next step is to adjust the estimated minimum volume of compression chamber 4 by selecting an end plate 3 having a projection 20 of appropriate height h and inserting that end plate in cylinder 1 (as shown in FIG. 1). Assuming that the cross-sectional area of bore 12 is A, the actual minimum volume of compression chamber 4 will roughly be equal to $A(D-h)$ (i.e., the projection decreases the minimum volume of compression chamber 4). Thus, h is selected in accordance with the desired (reference) minimum volume of compression chamber 4. The goal is to minimize the value $(D-h)$, which in turn will mean that the minimum volume of compression chamber 4 is minimized.

The volumetric efficiency of the compressor will be optimized when the minimum volume of compression 4 is minimized. To ensure that all compressors manufactured perform consistently, the value $(D_i - h_i)$ should be maintained constant from one compressor to the next, where $D_i$ is the measured interval for the i-th compressor and $h_i$ is the height of the projection on the i-th end plate. For each measured value $D_i$, an end plate 3 is selected which has a projection of height $h_i$ such that $(D_i - h_i) = \text{constant}$. In this manner, adjustments can be made to compensate for any irregularities in the length of interval $D_i$, produced due to the aggregate effect of the machining tolerances of the individual components.

It will be noted that in order to apply the above method, a plurality of end plates 3 must be prepared in advance to have projections 20 of different heights. These heights should vary by a small interval (perhaps 1/100 mm) over an entire range.

Thus, the volumetric efficiency of the compressor is enhanced by minimizing the minimum volume of compression chamber 4. This in turn contributes to improved performance of the compressor. Also, the volumetric efficiencies of the respective compressors can be maintained constant by compensating for dimensional variations produced by the aggregate effect of machining tolerances. This eliminates the possibility of a compressor performing irregularly.

Figure 4:
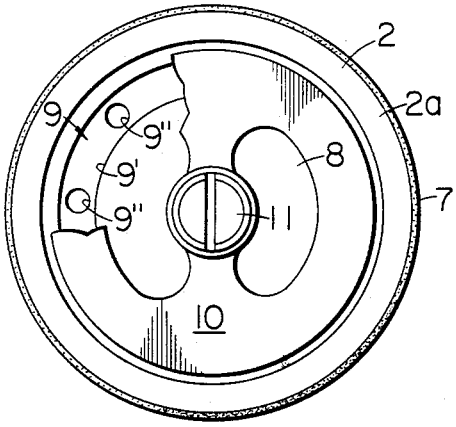
FIG. 4 is a plan view of the suction valve mounted on the piston according to the present invention, with part of the suction valve removed.

A further feature of the present invention is that suction valve 10 is seated on recessed valve seat surface 8 as shown in FIG. 4.

Thus, the top surface of suction valve 10 lies in the same plane as or slightly below the top surface 2*a* of piston 2. Since suction valve 10 does not project above the plane of top surface 2*a* of piston 2, top surface 2*a* can be more closely approached by end plate 3 at peak amplitude of the piston stroke (i.e., when the volume of compression chamber 4 is at a minimum). This further reduces the minimum volume of compression chamber 4, thereby enhancing the compression ratio of the compressor. The volumetric efficiency of compression chamber 4 is thus further improved.

Moreover, the recessed valve seat surface 8 on the end surface of piston 2 is less likely to collide with other components during handling of the pistons (e.g., when the compressor is assembled). As a result, the scratches caused by such collisions are avoided. Accordingly, the suction valve 10 is hermetically seated on valve seat surface 8, thereby ensuring proper functioning of suction valve 10 and significantly improving compressor performance as a whole.

It is understood that the preferred embodiment herein described is offered for purposes of illustration only and is not intended to preclude other embodiments which fall within the scope of the claimed invention.

We claim:

1. A method of assembling reciprocating compressors in order to increase the volumetric efficiency of said compressors by eliminating any irregularity in minimum volume of compression chambers for said respective compressors, which volume of each of said compression chambers is determined when a piston within the compression chamber is positioned at the top of its stroke thereby minimizing a top clearance of said piston, in which method a cylinder is provided including a first bore section and a second bore section of a diameter smaller than that of the former, into which second bore section is telescoped said piston for confronting across said compression chamber a closure end plate to be secured to said cylinder at the end of said first bore section, the method comprising the steps of:

(a) manufacturing in advance a plurality of groups of said end plates, each group of the end plates having an annular projection of a predetermined height h which differs from the heights of projections of the end plates in the other groups;

(b) defining a first reference position at a predetermined position of said piston at the top of its stroke and a second reference position on the wall of said cylinder and measuring an interval D between said first and second reference positions;

(c) selecting one appropriate group from said plurality of groups of the end plates for each pair of the cylinder and the piston fitted therein so that the difference D-h becomes a predetermined value common to all the pairs of the cylinder and piston for the compressors;

(d) securing an end closure plate of the selected group to the cylinder, thereby providing the reciprocating compressors of which compressor chambers have their minimum volume equalized to one another.

* * * * *